United States Patent [19]

Zimmer et al.

[11] Patent Number: 4,955,298

[45] Date of Patent: Sep. 11, 1990

[54] ROLLER DOCTOR OR SQUEEGEE APPARATUS FOR APPLYING FLUID MATERIAL TO A SUBSTRATE

[75] Inventors: Johannes Zimmer, Ebentaler Strasse 133, 9020 Klagenfurt; Franz Gütler, Klagenfurt; Engelbert Mörtl, Rottenmann, all of Austria

[73] Assignee: Johannes Zimmer, Klagenfurt, Austria

[21] Appl. No.: 328,081

[22] PCT Filed: Jun. 3, 1988

[86] PCT No.: PCT/EP88/00493

§ 371 Date: Mar. 15, 1989

§ 102(e) Date: Mar. 15, 1989

[87] PCT Pub. No.: WO88/09725

PCT Pub. Date: Dec. 15, 1988

[30] Foreign Application Priority Data

Jun. 3, 1987 [DE] Fed. Rep. of Germany ..... 8708044
Jun. 30, 1987 [DE] Fed. Rep. of Germany ..... 8709029

[51] Int. Cl.[5] ..... B41F 15/44

[52] U.S. Cl. ..... 101/120; 118/213

[58] Field of Search ..... 101/119, 120; 118/213

[56] References Cited

U.S. PATENT DOCUMENTS 4,036,129 7/1977 Zimmer ..... 101/120
4,094,241 6/1978 Kossler ..... 101/120

FOREIGN PATENT DOCUMENTS 2305443 8/1974 Fed. Rep. of Germany ..... 101/120

*Primary Examiner*—Clifford D. Crowder
*Attorney, Agent, or Firm*—Fay, Sharpe, Beall, Fagan, Minnich & McKee

[57] ABSTRACT

A roller doctor (squeegee) (1) for applying a fluid material (7), such as substances having different viscosity, coating substances, varnishes, adhesives, pastes, etc. to a substrate (4), has a magnetically chargeable doctor roller (2) and roller supporting members (11). Roller fixing parts (3) are fitted onto the doctor roller (2) and connected by a plug connection (10) to the roller supporting member (11). This leads to a universally usable roller doctor apparatus (1) with a modular structure.

28 Claims, 4 Drawing Sheets

ROLLER DOCTOR OR SQUEEGEE APPARATUS FOR APPLYING FLUID MATERIAL TO A SUBSTRATE

Figure 1:
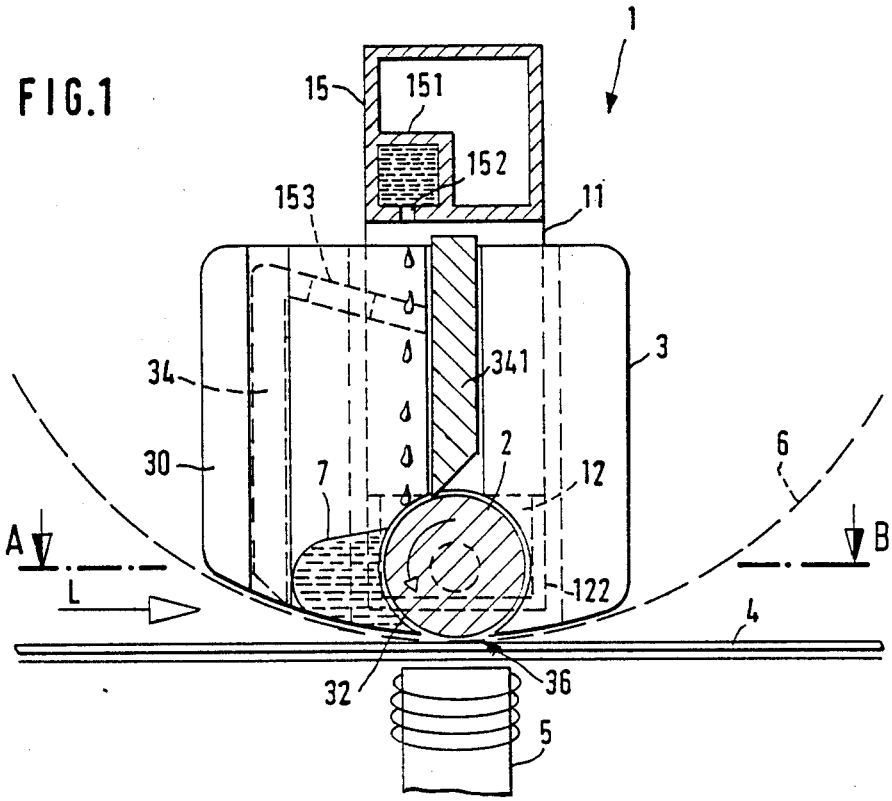

The invention relates to a roller doctor or roller squeegee apparatus for applying material, such as optionally foamable substances of different viscosities, coating substances, varnishes, adhesives, pastes, etc. to a substrate, such as a material web. The material is applied with at least one doctor roller magnetically chargeable for exerting pressure that extends in the longitudinal direction of the apparatus (application width), and with roller supporting and guiding members arranged laterally of the apparatus. The doctor roller is held for rotation and is varied in position within the boundaries of a cage-like receptacle.

Such an apparatus is used for flat screen printing, rotary screen printing and/or for screen or patternfree, whole-surface applications in printing or coating machines. It is possible to carry out patterning applications (printing) and/or whole-surface applications (e.g. impregnation, coating, dyeing, varnishing). The doctor roller and/or parts engaging it can be magnetized and are magnetically engaged by a magnet beam positioned below the substrate in order to exert pressure on the doctor roller for the application of the material. The function of the lateral roller supporting/guiding members is to prevent unintentional deflections or changes in position of the doctor roller with respect to its desired printing or normal position and to allow a lifting out of and possible transporting of the doctor roller.

Known roller doctor apparatuses comprise support plates (roller supporting/guiding members) arranged laterally on a support crossbeam and each having a cage-like receptacle for terminal positional limitation of the doctor roller. The support arrangement consisting of the crossbeam and lateral support plates must be specially dimensioned for each coating or printing machine and for each printing station as a function of the length and diameter of a doctor roller. In addition, known roller doctor apparatuses are also equipped with lateral substance limiting plates, which are either rigidly connected to the support pipe and can be lowered onto the substrate, or are displaceable in a perpendicular direction with respect to the support crossbeam. Depending on the desired length of a doctor roller, such substance limiting plate arrangements must be specially designed. Therefore the known roller doctor apparatuses must be designed for each application (coating) type and/or width, dependent on the roller diameter, wherein, particularly in the case of an application machine having several printing stations, it is necessary to make available differently dimensioned parts and to fit these parts in special association for each printing station. This leads to relatively expensive apparatuses, which are unsatisfactory with respect to handling and operation. A relatively expensive and complicated machine parts stock has to be kept available for such apparatuses. Further, the assembly and disassembly is relatively time consuming and must be carried out with carefully sorted, precisely matched parts.

In view thereof, the present invention is based on the task to provide a roller doctor apparatus for holding doctor rollers, which apparatus is designed to be particularly simple and compact, and is easily handleable and universally usable. The apparatus of the invention can be used as a unit in modular construction with doctor rollers of different diameters and lengths, whilst being easily and rapidly assemblable and disassemblable.

In conjunction with the initially mentioned features, this task is solved in that the doctor apparatus comprises at least one roller fixing part, which is fitted loosely onto one end of the doctor roller and is connected by means of a plug connection to the adjacent, lateral roller supporting and guiding member. With the roller fixing part, which can be fitted onto the doctor roller, and its plug connection to the roller supporting/ guiding member, doctor rollers of different length and/or different diameter can be arranged between the roller 1 guiding members. The roller fixing part provided between the end of the doctor roller and the roller supporting/guiding member ensures the adaptation required for each individual case is consistently available with the same design. As a whole, a fittable connection of the roller supporting/guiding member with the doctor roller and the roller fixing part fittable onto one end of said doctor roller is obtained in a very advantageous manner. The complete plugged arrangement, which can be handled as one part when in the mounted state, leaves with its parts an adequate clearance or boundary space for the guiding holding of doctor rollers of different diameters and lengths. Considerable economic and handling advantages are obtained. As a result of the modular plugged construction, a relatively short tooling or disassembly time is ensured, and plugged parts can be designed so simply that they can be handled without using any tools. Even when using doctor rollers of different lengths and/or diameters, the same dimensioning or spacing of the roller supporting/guiding members exists for each application (coating) machine or each printing station. As the basic equipment for an application or printing machine, only a single doctor apparatus according to the invention is required with one doctor roller, each, for different application widths and/or for different application quantities.

It is particularly advantageous that the plugged arrangement according to the invention be provided on both roller ends. As a result of the positional variability of a doctor roller on the roller fixing parts achieved through the plugged connection, only the same pair of roller fixing parts is required for different doctor rollers.

A very important embodiment of the roller doctor apparatus according to the invention is that each roller fixing part is designed as a substance limiting part determining the application width, and has an inclined or slanted surface guiding the substance to the doctor roller. The plugged arrangement, which is in one part when in the assembled state, in accordance with the invention consequently comprises, in a simple manner, an element laterally defining the application width and laterally limiting the substance. Due to the simple structure, the roller doctor apparatus according to the invention is particularly suitable for installation in the relatively narrow space of a rotary screen.

The plug connection of the roller fixing part together with the roller supporting/guiding member forms a clearance fit. According to a particular embodiment of the invention, it is provided that the lateral roller supporting/guiding member engages in a guide recess of the roller fixing part, the latter being positionally variable in the direction of the roller axis and/or transversely to said direction up to the particular abutment stop on the roller supporting/guiding member and/or on the doctor roller.

Particularly with regard to the applicability of doctor rollers of different lengths and/or diameters, it is particularly expedient that the roller fixing part have a bushing-like receptacle holding the roller end loosely over the roller circumference, which receptacle, together with the roller end, forms a clearance fit for the positional variability of the roller in the direction of its axis and transversely thereto. This also makes it possible that relatively small diameter doctor rollers having no journals are held and guided in a simple way.

A particularly advantageous embodiment of the roller doctor apparatus according to the invention lies in that an opening is formed on the receptacle of the roller fixing part in the area facing the substrate. This caplike design of the roller fixing part ensures that the doctor roller can be brought into engagement up to its ends, i.e. over its entire surface length on a substrate or optionally a screen or stencil.

The plugged arrangement according to the invention can, in particular, also be designed in that a roller fixing part is fitted loosely onto a journal or pivot pin of a doctor roller. It is particularly expedient that the journal pass through a plug bore of the roller fixing part and project into a cage-like recess formed on the roller supporting/guiding member. In order to achieve a self-alignment of the doctor roller with the journal in a simple manner, it is provided that the cage recess has at least one slanted butting face coming into guiding engagement with the free journal end when the doctor roller is in a tilted or skewed position, in particular, at least two butting faces being positioned in a frustum-cone-shaped manner with respect to one another, when seen in cross-section. When the doctor roller is in a skewed position, one of the butting faces ensures that a force is exerted on the free end of the journal, which brings the doctor roller back into the normal position again, i.e. into the desired printing position with respect to the substrate.

According to an embodiment of the invention, a guide or end journal preferably adjustable in the axial direction is arranged on the roller supporting and guiding member, onto which journal the roller fixing part is fitted. In particular, it is provided that the guide journal passes through a bore in the lateral wall of the roller fixing part and projects into a blind hole-like receptacle, which is frontally designed on the doctor roller. Appropriately, at least one slanted butting face is formed on the bottom of the roller receptacle, in particular at least two butting faces being positioned in a frustum-cone-shaped manner with respect to one another. When the doctor roller is in a skewed position, the free end of the guide journal comes into engagement with one of the butting faces, so that the doctor roller is automatically brought into its normal printing position.

In a particular embodiment of the invention, the roller doctor apparatus comprises at least one limiting member fitted in a cap-like manner onto the doctor roller and laterally guiding for sealing the substance, which member is arranged displaceably and fixably on the roller doctor apparatus, so that the application (coating) width can be adjusted to a relatively large degree.

The roller doctor apparatus according to the invention may very advantageously comprise a substance limiting ledge or rail extending over the application width. Such a substance limiting ledge is arranged between two roller fixing parts and/or lateral substance limiting members fitted onto the two roller ends, and is held on the lateral parts by a plug connection. Appropriately each lateral part is provided with at least one slot and a substance limiting ledge can be inserted or pushed into two corresponding slots. Viewed in the application direction, a substance limiting ledge can be positioned upstream of the doctor roller, so as to form a substance damming-back space between the ledge and the doctor roller. A substance limiting ledge can also be placed between a pair of lateral parts in such a way that the ledge sealingly engages on the doctor roller along the application width with its long narrow side or edge, so as to prevent the substance from passing into the space located behind the doctor roller. It is particularly appropriate for such a ledge to comprise a holding magnet optionally pivotable about an axis parallel to the longitudinal direction of the apparatus. On switching off a magnetic beam magnetically attracting the doctor roller, the latter is attracted by the holding magnet and held magnectically against the ledge, so that it can be removed comfortably together with the ledge from the roller doctor apparatus or inserted thereinto.

It is particularly expedient to arrange a locking (securing) part locking the plugged arrangement of the doctor apparatus on the roller supporting and guiding member, which locking part, in a locking position, engages over the roller fixing part, whereas in a release position it ensures the removal of the roller fixing part together with the doctor roller. The roller supporting and guiding member is arranged on the doctor apparatus, e.g. on a supporting crossbeam extending over the application width, to be preferably displaced and fixed. It is readily possible to secure all of the connections of the plugged arrangement according to the invention with manually operable locking parts, such as socket pins or the like, so that in this way any undesired releasing of the plugged connection is avoided.

According to a special embodiment of the invention, it is provided that the roller supporting/guiding members be fixed to a supporting crossbeam, which is preferably simultaneously designed as a substance supply line. Thus, in combination with the plugged arrangement for the doctor roller according to the invention, a very compact roller doctor apparatus is obtained, which has substance supply and roller guidance functions that are substantially independent of the dimensions of a doctor roller. The crosslatter beam having a substance supply is designed in such a way that in the crossbeam there is arranged a substance supply line with at least one substance outlet, which issues into an outlet of the crossbeam. Such a substance supply line arranged in the crossbeam also has the advantage of a particularly sparing ink or dye supply, but which is still an integral part of the overall roller doctor apparatus comprising the plugged arrangement with the doctor roller.

The roller doctor apparatus according to the invention is particularly suitable for the additional arrangement of an optionally magnetizable loading (charging) roller, which extends over the doctor roller side remote from the substrate and engages the doctor roller. Like the doctor roller, it is arranged and held with the mountable roller fixing parts in plug connection between the roller supporting and guiding members. Thus, such a loading roller is incorporated into the assemblable connection of the roller doctor apparatus according to the invention, so that overall a one-part apparatus designed with plug parts is obtained which can be manipulated easily. As a result of the clearance fits of the plugged arrangement, it is advantageously achieved that not only is it possible to use differently dimensioned doctor rollers in the same doctor roller apparatus, but also loading rollers of different lengths and/ or diameters.

The plugged arrangement according to the invention designed with clearance forms a functional unit that can be handled easily, as a result of the usability of different doctor rollers in the same apparatus. It is particularly appropriately applicable in connection with doctor or squeegee rollers, whose surfaces are smooth or roughened and/or provided with an elastic covering. Such doctor rollers can be used over the entire surface length, particularly when using cap-like roller fixing parts, which have an opening on the side facing the substrate.

Further expediences, types of realisation and embodiment examples of the invention can be taken from the subclaims and from the hereinafter explained diagrammatic drawings, wherein.

Figure 2:
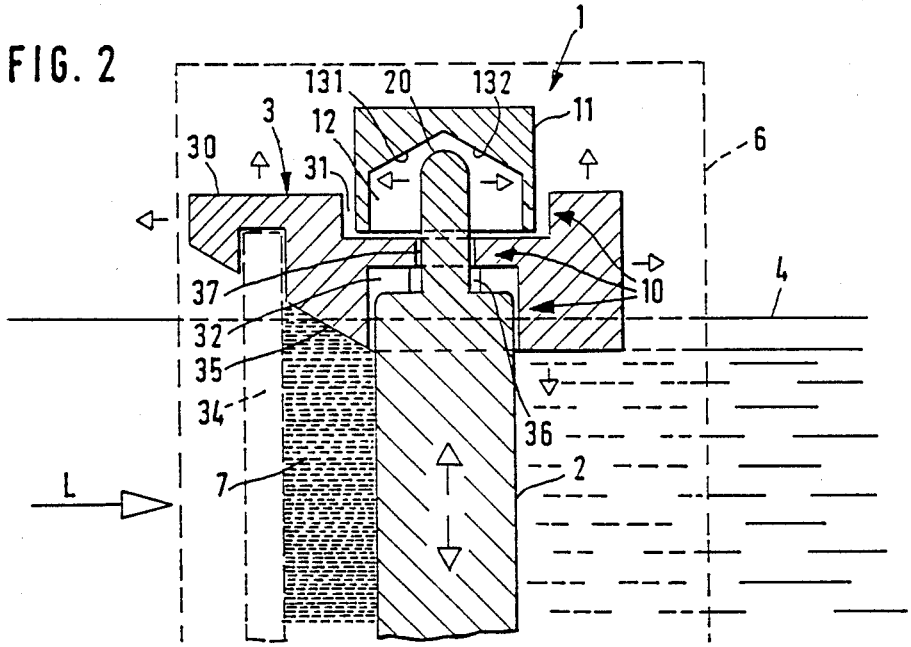
Figure 3:
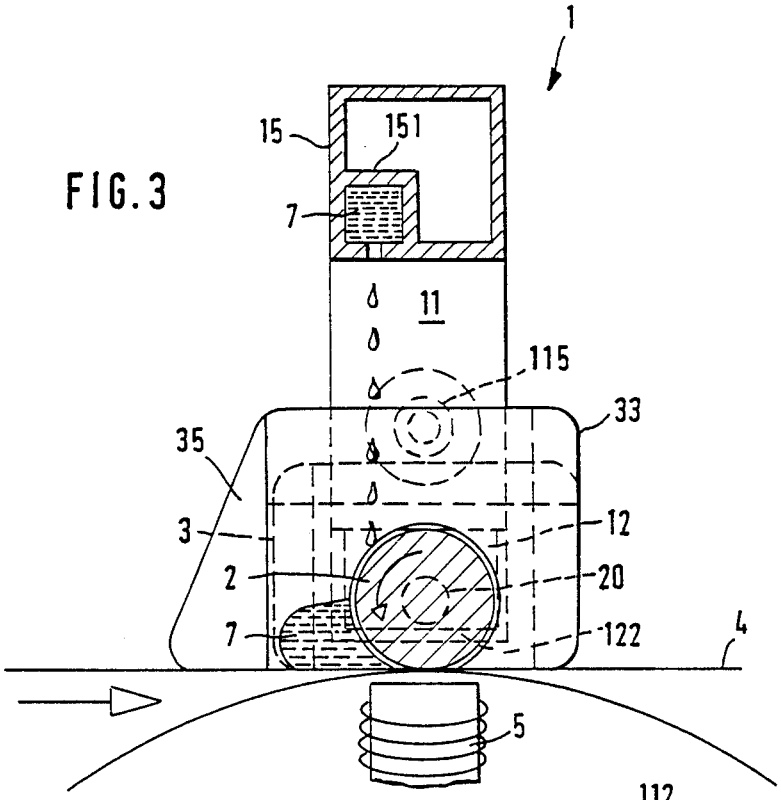
Figure 4:
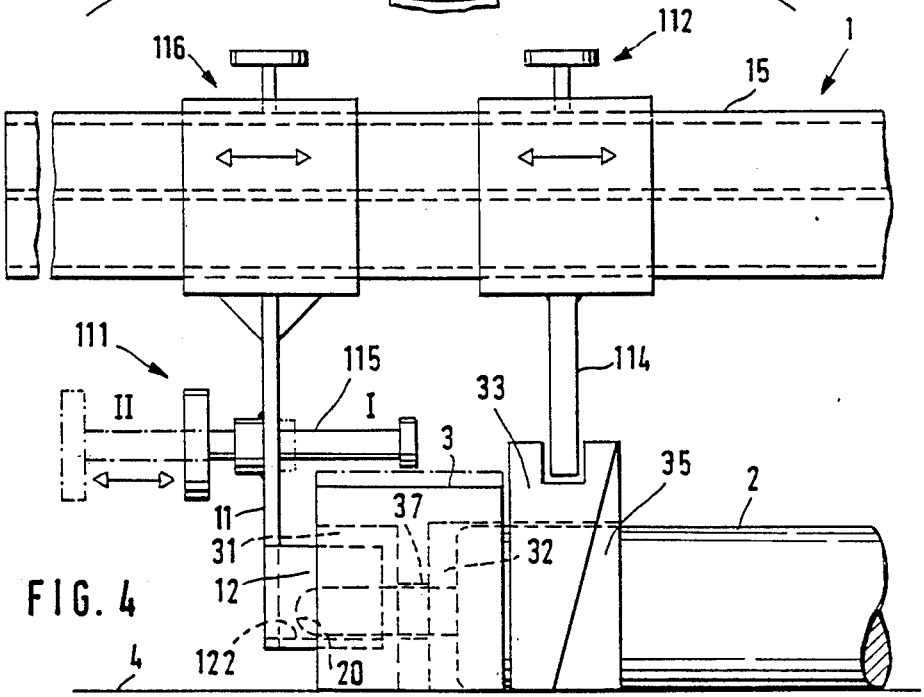
Figure 5:
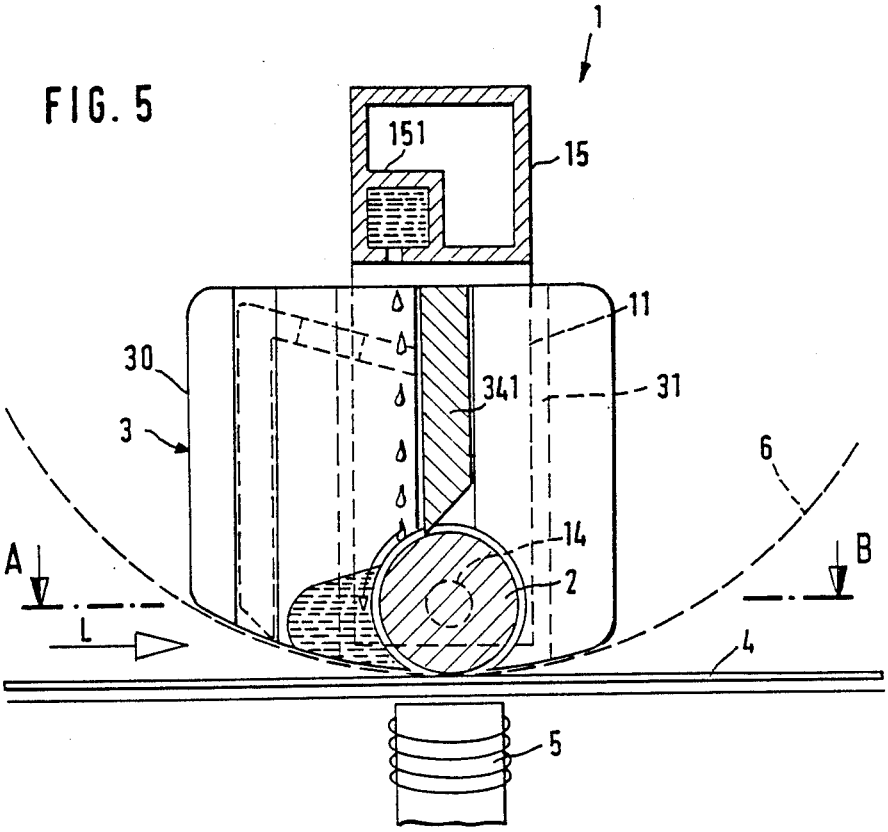
Figure 6:
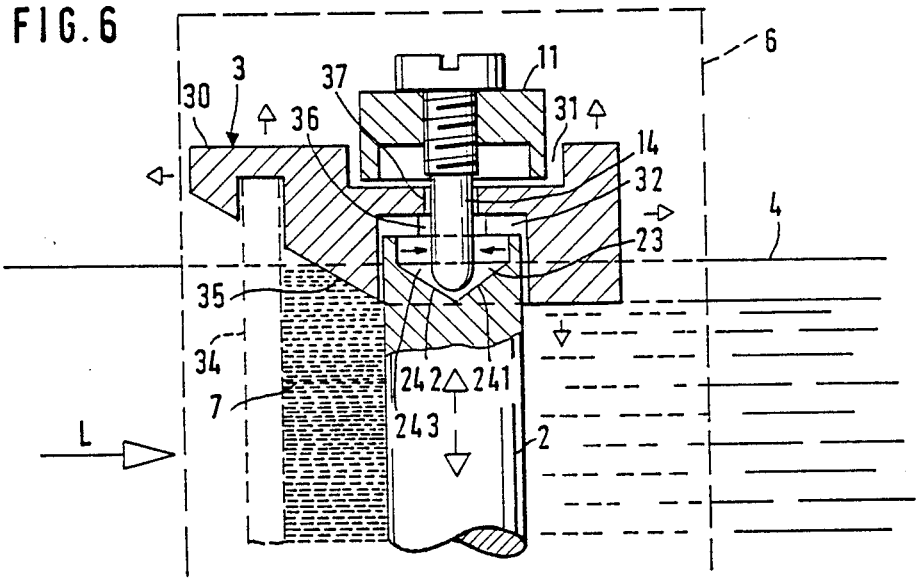
Figure 7:
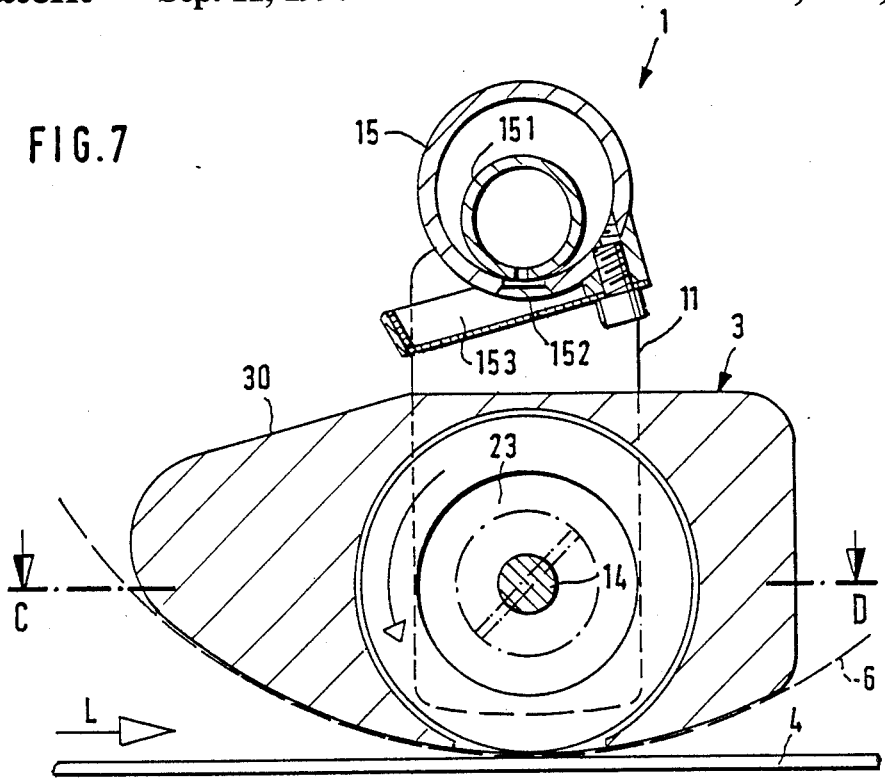
Figure 8:
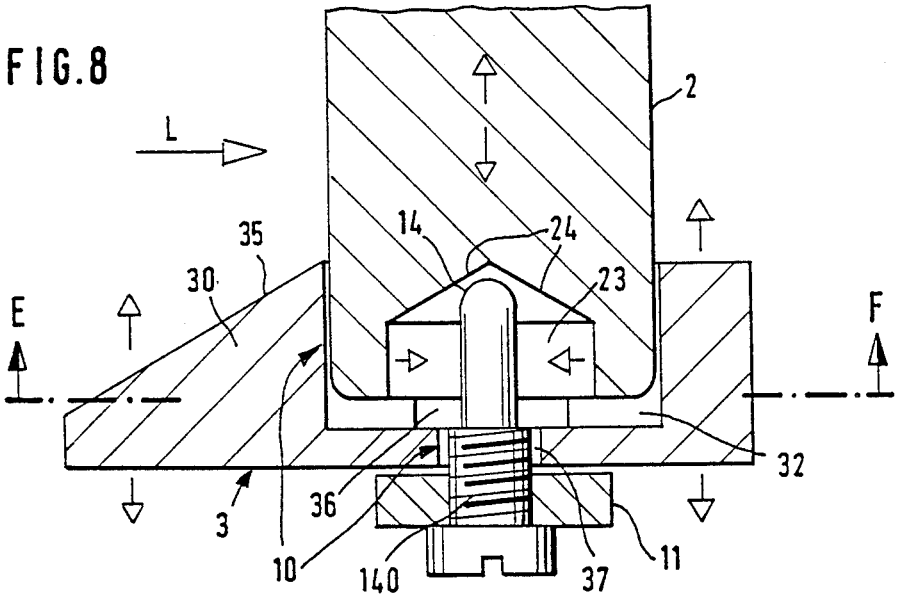

FIGS. 1 and 2, show in section and in side view and in partial plan view (section A–B), respectively, a roller doctor or squeegee apparatus according to the invention in plug connection with a doctor roller having a journal, FIG. 3 shows in side sectional view, a doctor or squeegee apparatus according to the invention in plug connection with a doctor (squeegee) roller having a journal and with a cap-like substance limiting member fitted on the doctor roller for adjusting the application width, FIG. 4 shows in partial longitudinal view, a doctor (squeegee) roller apparatus according to the invention substantially corresponding to FIG. 3, FIGS. 5 and 6, each show in section, in side view and partial plan view, respectively, a doctor (squeegee) roller apparatus according to the invention in plug connection with a guide journal arranged on a roller supporting/guiding member and engaging in a frontal blind hole of a doctor roller, FIGS. 7 and 8, each show in section, in side view (section E–F) and partial plan view (section C–D), respectively, of a roller doctor (squeegee) apparatus according to the invention in plug connection with a guide journal arranged on a roller supporting/guiding member and engaging in a frontal blind hole of a doctor roller.

Each of the drawings shows a roller doctor or squeegee apparatus 1 with the parts essential for the invention.

According to FIGS. 1 and 2 and 5 to 8, a roller doctor apparatus 1 is arranged within a rotary screen (round or circular screen or stencil) 6, indicated in broken line form, of a printing station of an application machine.

FIG. 3 shows a roller doctor (squeegee) apparatus 1 in a not shown printing machine for full-surface application to a material web (substrate) 4.

In each case, a magnetizable doctor roller 2 is magnetically pressed against the material web 4 by an electromagnet 5 arranged below the web 4 and extending over the application width. Due to the rotation of the doctor roller 2 about its longitudinal axis an application substance 7 is applied upstream of the roller 2, considered in the application direction L, optionally through the patterning screen 6 to the material web 4. The material web 4 can be guided or held on a blanket and/or a contact surface.

The position of the doctor roller 2 is determined by the magnetic beam 5 positioned below the material web 4, so that there is no real need for a mounting of the doctor roller 2. In order to position the doctor roller 2 and/or to prevent its migration or passing into a transverse position with respect to the material web 4, in the vicinity of its ends, the roller 2 is guided and held by means of plug-like mounted clearance fittings 10. Each lateral guide ensures a free rotation of the roller 2, but also ensures that the position or displacement of the roller 2 in the direction of its axis and transversely thereto (in and counter to application direction L) remains clearly limited. It must also be ensured that the doctor roller 2 can be inserted in and removed from the printing station in a simple and damage-free manner. All these functions are achieved in an ideal manner by means of the assembled connections according to the invention described in an exemplified manner hereinafter.

On either side of the doctor roller 2 are arranged roller supporting and guiding members 11 which, as shown in FIGS. 1 and 3 to 5, are designed in the form of plates or profile parts, each of which is laterally fixed to a support crossbeam 15 extending over the application width, and is arranged perpendicularly to the plane of the material web 4 whose lower parts are in the vicinity of the roller ends.

According to the invention, roller fixing parts 3 each are held between the lower part of a roller supporting/guiding member 11 and the end of a roller 2, one t each end of roller 2 respectively. Each plugged arrangement 10 designed according to the invention (correspondingly provided at both roller ends) comprises the roller fixing part 3 in plug connection with the roller supporting/guiding member 11 and the doctor roller 2.

According to FIGS. 1 and 2 the roller fixing part 3 is designed with three aligned clearance fittings 10.

A guide recess 31 extending perpendicularly to the material web 4 is provided on the outside of part 3, which recess has a common wall with a blind hole-like bush(ing) receptacle 32 provided on the inside of the roller fixing part 3. A through-hole or -bore 37 is formed in the wall. The receptacle 32 is placed on the circumferential end of the roller 2. The roller 2 carries a roller-fixed journal 20, which traverses the through-hole 37. The roller supporting/guiding member 11 engages in the guide recess 31 of the roller fixing part 3, which can be removed upwards.

In the region of the doctor roller 2 and on the side facing the latter, the member 11 is provided with a cage-like receptacle 12, so that the free rounded end of the journal 20 projects into the cage receptacle 12. The bottom of the cage 12 is provided with butting faces 131, 132 arranged in V-shaped manner and which, when the doctor roller 2 is in a slanted or inclined position, bring about automatically an orientation of the roller 2 aligned with the V-axis whilst engaging the circular end of the journal. The recess 31, the bore 37 and the receptacle 32 each have diameters such that there are adequate clearances with respect to the parts 11, 20, and 3, respectively, engaging therein, so that free mobility of the roller 2 is ensured within the clearance fitting boundaries.

The roller doctor apparatus 1 is so aligned with the magnet 5, that during troublefree printing the doctor roller 2 is not in contact with the plugging parts 11 and 3. In the case of an operationally caused disturbance force on the doctor roller 2, the end of the latter engages on a boundary face of one of the clearance fittings, so that any migration of the doctor roller 2 is reliably prevented. The plugged arrangement or the clearance fittings thereof, respectively, are dimensioned in such a way that only a minor clearance of the doctor roller is possible.

The bore 37 and the receptacle 32 are circular in cross-section. In the area facing the substrate 4 or the stencil 6, respectively, the receptacle 32 has an opening 36, so as to expose the roller 2 with its surface also in the region of the roller fixing part 3 and so as to permit engagement with the screen 6 or the substrate 4, respectively.

The length of the journal 20 and the bore depth of receptacle 32 are such that between the roller supporting/ guiding member 11 and the frontal end of the outer surface of roller 2 there is provided a relatively large spacing. Within the latter the roller fixing part 3 is movable in the longitudinal direction of the apparatus 1 or in the axial direction of the roller 2, respectively.

The roller fixing part 3 is designed as a lateral substance limiting part 30. In the area upstream of the doctor roller 2 (viewed in the running direction L), there is an inclined face 35, which is directed perpendicular to the substrate web 4 and slopes on the doctor roller 2 from the outside of apparatus 1. Thus, the substance 7 is clearly defined and brought within the desired application width limitations to the doctor roller 2. As can be gathered from FIG. 1, the substance limiting part 30 is adapted to the shape of the rotary screen 6 in the region of the space for substance 7 in order to come into limiting engagement therewith.

Between the two roller fixing/substance limiting parts 3/30 fitted onto the two roller ends there is provided a substance limiting rail or ledge 34 extending over the application width, which ledge forms a space for substance 7 between faces 35 and doctor roller 2. On each of the parts 30 is formed a vertical slot, in which is inserted in plug connection the substance limiting ledge 34. The distance between the parts 30 on both sides can be determined by the length of ledge 34.

It is clear that part 3/30 in plug connection with doctor roller 2 can be moved and aligned together with the latter.

In place of the doctor roller 2 shown in FIGS. 1 and 2, it is readily possible to insert a smaller diameter roller doctor 32. It is also clear that the apparatus 1 in plug connection with all of the parts 15, 11, 3, 2 and optionally 34 can be handled as a unit.

A doctor apparatus 1 according to FIGS. 3 and 4 comprises a substance limiting member 33 restricting the application width and which has a through-bore, which is open in slot-like manner on the side facing substrate 4. Thus, member 33 is fitted in cap-like manner onto the doctor roller 2 and is displaceable along its length, so that the application width can be adjusted at random. Like the substance limiting part 30 described relative to FIGS. 1 and 2, the member 33 has a sloping surface 35, which laterally delimits the substance and supplies it to the roller 2

FIG. 4 shows the member 33 in an abutment position against the roller fixing part 3. For reducing the application width, it can be pushed out of this position by means of a fixable sliding guide 112 arranged on the crossbeam 15. To this end, a finger 114 fixed to the sliding guide 112 engages in a recess of the substance limiting member 33. The further plugged arrangement of the roller doctor apparatus 1 with the doctor roller 2 having the journal 20, with the roller fixing parts 3, and with the roller supporting/guiding members 11 is designed in the same way as the plug connection according to FIGS. 1 and 2.

In the embodiment according to FIG. 4, a securing or locking part 111 is placed on the roller supporting and guiding member 11 above the cage-like receptacle 12. The locking part comprises a socket pin 115. In a securing position I fixable on the member 11 the pin 115 engages the roller fixing part 3, so that the plug connections between the parts 11, 3, 33 and 2 are not detachable. As a result of this locking effect, the complete doctor apparatus 1 can be handled and in particular transported upside down without the plugged connections falling apart. In the position of the socket pin 115 shown in dash-dotted lines, the roller fixing part 3 and the roller 2 can be removed upwardly. For this purpose the finger 114 is removed by means of the sliding guide 112 from the recess of the substance limiting member 33.

In the embodiment according to FIG. 4 the roller supporting/guiding member 11 is arranged movably in the longitudinal direction of the apparatus and in the direction of the roller axis, respectively, by means of a fixable sliding guide 116 arranged on the crossbeam 15. It is apparent that the plugged arrangement ca be released by a displacement of the sliding guide 116 towards the outside of the apparatus 1. With the sliding guide 116 for the roller supporting/guiding member 11 it is, on the other hand, possible to adjust, in a simple manner, the spacing between the shown member 11 and the roller supporting/guiding member arranged on the other roller end.

FIG. 4 makes it clear that the journal 20 of the roller 2 is engaged on the web part 122 of the receptacle 12 during the transportation of the apparatus 1.

A plugged arrangement of a roller doctor apparatus 1 according to FIGS. 5 and 6, as in the embodiment according to FIGS. 1 and 2, comprises a roller fixing part 3, which is fitted onto a journal, a doctor roller 2 and a roller supporting/guiding member 11. To this extent the arrangement coincides with the embodiment according to FIGS. 1 and 2. However, as is apparent from FIG. 6, the roller 2 has no journal.

A guide journal 14, which takes the place of a roller journal is arranged on the roller supporting/guiding member. The journal 14 passes through the through-bore 37. On the end of the roller 2, there is frontally provided a blind hole-like recess 23, into which projects the free rounded end of journal 14. V-shaped butting faces 241, 242 and 243 are provided on the bottom of the recess or receptacle 23. If, as a result of an inclined positioning of the roller 2, said faces engage with the journal curvature, the roller 2 with its longitudinal axis is returned to an aligned position with the guide journal 14. Journal 14 is provided in the form of the shank end of a screw arranged on a roller supporting/guiding member 11. This makes it possible to adjust, in a simple way, the length with which the journal 14 is to project into the receptacle 32 or the blind hole 23, respectively. It is apparent that, in this way, it is possible to easily adjust the journal position for guiding engagement with the butting faces of doctor rollers 2 of different lengths.

An embodiment according to FIGS. 7 and 8 essentially corresponds to the structure of the doctor apparatus 1 or the plugged arrangement according to FIG. 6, respectively. In this embodiment, the plug connection of the roller fixing part 3 with the roller supporting/- guiding member 11 is made with a screw pin 14. A through-bore 37 receives a larger diameter part 140 of a screw pin 14 with a clearance fit. The screw pin 14 is adjustable by a screw connection with the roller supporting/guiding member 11.

In FIGS. 2, 6 and 8 the mobility of the doctor roller 2 and the roller fixing part 3 within the plugged arrangement is designated by means of movement arrows.

As is apparent from FIGS. 1, 3 and 5, a substance supply line 151 is arranged within the crossbeam 15, the substance 7 passing through an outlet port 152 into the space upstream of the doctor roller 2. According to FIG. 7, a substance supply pipe 151 is provided in and aligned with the crossbeam 15, a substance being led via a distribution channel 153 into the space upstream of the doctor roller 2.

In the embodiments according to FIGS. 1 and 5, a substance limiting rail or ledge 341 is provided, which is inserted into vertical slots on the roller fixing parts 3 above the roller, i.e. on the roller side remote from the substrate web 4. Such a ledge 341, like the previously described substance limiting ledge 34, can be pushed or inserted in simple manner by a plug connection between the roller fixing parts 3. One edge of the ledge 341 sealingly engages the doctor roller over the application width and thus prevents the substance from passing into the space behind the doctor roller, when viewed in the application direction L. Expediently, the ledge is designed as a permanent magnet 341. This ensures that the magnetizable doctor roller 2 is magnetically attracted by the ledge 341 in the case of demagnetization of the electromagnet 5 and can consequently be handled and transported therewith, in a particularly easy manner. It is also possible to position a substance limiting ledge engaging with the doctor roller behind the latter, when seen in the application direction L.

We claim:

1. A roller doctor apparatus (1) for applying fluid material over an application area on a substrate with at least one doctor roller (2) magnetically attracted into engagement with the substrate for exerting pressure thereagainst, said roller extending in the longitudinal direction of the apparatus; roller supporting and guiding members (11) arranged laterally on the apparatus, said doctor roller (2) being held at its ends between said members (11) for rotation and for limited movement relative thereto, wherein the doctor apparatus (1) comprises at least one roller fixing part (3) with an indentation on each side thereof, said part fitted loosely onto one end of the doctor roller (2) and trapped between the roller and the roller supporting and guiding member, and wherein the member (11) projects into one of said indentations with the roller projecting into the other indentation to form a plug connection (10).

2. A roller doctor apparatus according to claim 1, wherein each of the two roller ends has fitted thereon a roller fixing part (3) each connected by one said plug connection (10) to the adjacent roller supporting and guiding member (11).

3. A roller doctor apparatus according to claim 1, wherein the roller fixing part (3) has an application width-determining part (30) for limiting the application width of the fluid material.

4. A roller doctor apparatus according to claim 3, wherein each application width-determining part (30), has slanting faces (35) guiding the material to the doctor roller (2).

5. A roller doctor apparatus according to claim 1, further comprising: on the side remote from the doctor roller (2), the roller fixing part (3) has a guide recess (31), the roller supporting and guiding member (11) being engaged in said guide recess, and the roller fixing part being positionally variable to a limited extent through the plug connection with the roller supporting and guiding member (11) and with the doctor roller (2).

6. A roller doctor apparatus according to claim 1, wherein the roller fixing part (3) has a bushing-like receptacle (32) loosely holding the roller end over the roller circumference.

7. A roller doctor apparatus according to claim 6, wherein the receptacle (32) opens downwardly to face the substrate (4).

8. A roller doctor apparatus according to claim 1, wherein the doctor roller (21) is provided with a journal (20) on which is fitted the roller fixing part (3).

9. A roller doctor apparatus according to claim 8, wherein the roller supporting and guiding member (11) comprises a receptable (12) having a recess (121) which receives a free end of the journal (20) passing through the roller fixing part (3).

10. A roller doctor apparatus according to claim 9, wherein the receptacle (12) has two slanted butting faces (131, 132) which come into guiding engagement with the free journal end when the doctor roller (2) is in a tilted or skewed position, said two butting faces (131, 132) being positioned in a frustum-cone-shaped manner to one another, when seen in cross-section.

11. A roller doctor apparatus according to claim 1, further comprising an axially adjustable guide journal (14), on which is fitted the roller fixing part (3), said guide journal 14 being arranged on the roller supporting and guiding member (11).

12. A roller doctor apparatus according to claim 11, wherein the doctor roller (2) is frontally provided with a receptable (23) into which projects a free end of the guide journal (14).

13. A roller doctor apparatus according to claim 12, further comprising: two slanted butting faces (241, 242) provided on a bottom of a roller receptacle (23), which come into guiding engagement with the free end of the guide journal (14) when the doctor roller (2) is in a tilted or skewed position, in particular at least said two butting faces (241, 242) being in frustum-cone shaped manner to one another, when seen in cross-section.

14. A roller doctor apparatus according to claim 1, wherein the roller doctor apparatus (1) has at least one substance limiting member (33) fitted loosely on the doctor roller (2) that determines the application width, that is open in the area facing the substrate (4), and that is movable on a supporting crossbeam (15) extending in the longitudinal direction of the apparatus.

15. A roller doctor apparatus according to claim 1, further comprising: said supporting and guiding member (11) having securing part means (111) for locking the plug connections of the doctor apparatus (1) by engaging the roller fixing part (3) in a locking position to prevents removal of the roller fixing part (3) from the roller supporting and guiding member (11), and by permitting the removal of the roller fixing part, together with the doctor roller (2) in a release position.

16. A roller doctor apparatus according to claim 1, further comprising: the roller fixing part (3) being displaceable in the direction of the roller axis and means for fixing the roller fixing part in a displacement position on the doctor apparatus (1).

17. A roller doctor apparatus according to claim 1, further comprising: the roller supporting and guiding member (11) being displaceable in the direction of the axis of the doctor roller (2), and means for fixing the roller supporting and guiding member.

18. A roller doctor apparatus according to claim 1, wherein the roller supporting and guiding member (11) is fixed to a crossbeam (14) extending over the application area of the apparatus (1).

19. A roller doctor apparatus according to claim 18, wherein the crossbeam (15) has a substance supply line 151.

20. A roller doctor apparatus according to claim 19, wherein the crossbeam (15) has a distribution channel (153) that communicates with said substance supply pipe (151) for distributing a substance upstream of the doctor roller (2).

21. A roller doctor apparatus according to claim 18, further comprising a substance supply line (151), arranged in the supporting crossbeam (15), and having at least one substance outlet (152) issuing into a crossbeam outlet.

22. A roller doctor apparatus according to claim 1, further comprising a ledge (34) and means for supporting opposite ends of the ledge adjacent opposite ends of the doctor roller (2), said ledge (34) extending widthwise over the application area for limiting a thickness of the fluid material and being detachably connected to said ledge supporting means.

23. A roller doctor apparatus according to claim 22, wherein said means for supporting the ledge includes slots in each of said roller fixing parts (3) arranged on the opposite ends of the doctor roller (2) for receiving the opposite ends of the ledge.

24. A roller doctor apparatus according to claim 22, further including a substance limiting ledge (341) that engages the doctor roller (2) along a top surface of the doctor roller for sealing the top surface of the roller doctor.

25. A roller doctor apparatus according to claim 24, wherein said substance limiting ledge (341) is a permanent magnet for magnetically attracting the doctor roller.

26. A roller doctor apparatus according to claim 1, further comprising a substance limiting ledge (341) and means for supporting the substance limiting ledge from opposite ends adjacent opposite ends of the doctor roller (2), said substance limiting ledge (341) engaging the doctor roller (2) along a top surface of the doctor roller (2) to seal the top surface of the doctor roller (2).

27. A roller doctor apparatus according to claim 26, wherein said means for supporting the substance limiting ledge (341) at opposite ends adjacent the doctor roller (2) includes slots in each of the roller fixing parts (3) for receiving the opposite ends of the substance limiting ledge (341).

28. A roller doctor apparatus according to claim 26, wherein said substance limiting ledge (341) is a permanent magnet for magnetically attracting the doctor roller (2).

* * * * *